US009075398B2

(12) United States Patent
Triki

(10) Patent No.: US 9,075,398 B2
(45) Date of Patent: Jul. 7, 2015

(54) WAKE UP ALARM PROVIDING DEVICE

(75) Inventor: Mahdi Triki, Helmond (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 67 days.

(21) Appl. No.: 14/113,039

(22) PCT Filed: May 3, 2012

(86) PCT No.: PCT/IB2012/052215

§ 371 (c)(1), (2), (4) Date: Oct. 21, 2013

(87) PCT Pub. No.: WO2012/153241

PCT Pub. Date: Nov. 15, 2012

(65) Prior Publication Data

US 2014/0050055 A1 Feb. 20, 2014

(30) Foreign Application Priority Data

May 12, 2011 (EP) ..... 11165862

(51) Int. Cl.
*G04B 23/00* (2006.01)
*G04G 13/02* (2006.01)

(52) U.S. Cl.
CPC ..... *G04G 13/023* (2013.01); *G04G 13/02* (2013.01)

(58) Field of Classification Search
CPC ..... G04B 23/10; G04B 13/21; G04B 23/08; G04B 21/022; G04G 13/02; G04G 13/023
USPC ..... 368/243–245, 10
See application file for complete search history.

(56) References Cited

U.S. PATENT DOCUMENTS

| | | | | |
|---|---|---|---|---|
| 5,870,484 | A | 2/1999 | Greenberger | |
| 6,014,345 | A * | 1/2000 | Schmadeka | 368/10 |
| 7,382,885 | B1 * | 6/2008 | Kim et al. | 381/17 |
| 7,697,695 | B2 * | 4/2010 | Sakagami | 381/17 |
| 8,184,846 | B1 * | 5/2012 | Craine | 381/388 |
| 8,593,912 | B1 * | 11/2013 | Amores | 368/79 |
| 2002/0186618 | A1 * | 12/2002 | Kirkpatrick | 368/11 |
| 2006/0017559 | A1 * | 1/2006 | Albert | 340/531 |
| 2006/0153007 | A1 * | 7/2006 | Chester | 368/12 |
| 2009/0208022 | A1 | 8/2009 | Fukui et al. | |
| 2011/0025915 | A1 * | 2/2011 | Daban | 348/552 |
| 2011/0235469 | A1 * | 9/2011 | Irwin | 368/12 |
| 2013/0083632 | A1 * | 4/2013 | Al Abdeen | 368/10 |

FOREIGN PATENT DOCUMENTS

| | | | |
|---|---|---|---|
| EP | 19715793 | A1 | 10/1998 |
| JP | 2008070303 | A | 3/2008 |
| WO | 2011117903 | A2 | 9/2011 |

* cited by examiner

*Primary Examiner* — Sean Kayes

(57) ABSTRACT

A wake up alarm providing device (10) is provided, comprising a sound producing unit (11) and a control unit (12), coupled to the sound producing unit (11). The sound producing unit (11) is arranged to provide an audible wake up signal during an alert period. The control unit (12) controls the wake up signal to comprise a diffuse sound during a first part of the alert period and to comprise a localized sound during a subsequent part of the alert period.

11 Claims, 4 Drawing Sheets

WAKE UP ALARM PROVIDING DEVICE

CROSS-REFERENCE TO PRIOR APPLICATIONS

This application is the U.S. National Phase application under 35 U.S.C. §371 of International Application No. PCT/IB2012/052215, filed on May 3, 2012, which claims the benefit of European Patent Application No. 11165862.1, filed on May 12, 2011. These applications are hereby incorporated by reference herein.

FIELD OF THE INVENTION

This invention relates to a wake up alarm providing device comprising a sound producing unit for providing an audible wake up signal during an alert period and a control unit, coupled to the sound producing unit for controlling the wake up signal.

This invention further relates to a method of providing an audible wake up signal and a computer program product for performing said method.

BACKGROUND OF THE INVENTION

Many people use an alarm clock to be sure to wake up in time. Most alarm clocks use a loud and annoying sound to inform the user that it is time to get up. Such an alarm usually causes an abrupt wake up, which is not appreciated by many users. It is well known to use sounds from a radio, CD player or other source of music instead of a standard wake up alarm. Cell phone alarms often provide the option to select an alarm sound from a number of available options. The sound produced by such alarm clocks may be less unpleasant, but the abruptness of the alarm may still lead to discomfort.

Most people feel more energetic and fit after a gentle/pleasant wake up ritual. To fulfill this need, Philips has, e.g., introduced a wake up light, enhancing the wake up experience with sunrise simulation and natural sounds. The sunrise simulation is realized by gradually increasing illumination. Furthermore, progressive alarm clocks are known, using loudness control to increase the sound level during a wake up ritual.

Although such solutions are already improving the pleasantness of the wake up ritual, there still is a need for even more gentle and pleasant wake up experiences.

OBJECT OF THE INVENTION

It is an object of the invention to provide a wake up alarm providing device which gives an even more pleasant and gentle wake up experience.

SUMMARY OF THE INVENTION

According to a first aspect of the invention, this object is achieved by providing a wake up alarm providing device comprising a sound producing unit for providing an audible wake up signal during an alert period and a control unit, coupled to the sound producing unit for controlling the wake up signal, the control unit being arranged to control the wake up signal to comprise a predominantly diffuse sound during a first part of the alert period and a more localized sound during a subsequent part of the alert period. The control unit is arranged such that the localized sound provides, at a predetermined target position, a localized spatial sound spectrum having a maximum sound intensity from a single predetermined direction and the diffuse sound provides, at the predetermined target position, a diffuse spatial sound spectrum having peak sound intensities from multiple directions. The wake up signal is controlled such that a sum of the peak sound intensities of the diffuse sound exceeds the maximum sound intensity of the localized sound during the first part of the alert period, and that a ratio of the sum of the peak sound intensities of the diffuse sound to the maximum sound intensity of the localized sound is decreased during the subsequent part of the alert period.

Studies have shown that spatial attributes of sounds have a major influence on auditory experiences. However, up to now spatial attributes have not yet been exploited in relation to wake up alarms. The inventors have found out that it is possible to improve wake up rituals by controlling spatial attributes of the wake up alarm sound. According to the invention, the wake up signal changes from diffuse or ambient to localized or focused. Diffuse sounds provide an immersive audio experience with sounds appearing to be originating from a multitude of origins. Localized sounds are better intelligible and appear to come from a single sound source. The immersive dream-like sounds cause a user to wake up slowly in such a way that the alertness level has already increased substantially when the subsequent localized sound causes the user to wake up completely.

Localized sound is perceived as coming directly from a single source of sound to the user. Diffuse sound comes from multiple directions, e.g. because the source is delocalized (e.g. street noise, a plurality of birds) or because the sound only reaches the user after various reflections. A purely diffuse sound shows a similar sound intensity from a large range of directions or multiple peak sound intensities from different directions. A purely localized sound shows a clear maximum sound intensity from a single predetermined direction. During the alert period, a ratio of diffuse sound to localized sound decreases. This decrease may be realized gradually or in one or more discrete steps.

Technically, the producing of diffuse and localized sounds can be realized in a number of different ways. Signal processing and digital reverberation may be used to change a perceived directionality of the wake up signal from diffuse to localize. Multiple loudspeakers provided at different angles with respect to the user may be used. A rotatable loudspeaker may be used, which rotates towards the user during the alert period. Also other solutions for providing diffuse and localized sounds are apparent for the person skilled in the art.

The gentle and more pleasant wake up process is further improved when the control unit in the wake up sound producing device is arranged to provide a gradual transition from the diffuse sound to the localized sound. During this gradual transition, when the user wakes up, the alarm may be turned off. The gradual transition does not only provide a smooth and gentle change of the auditory environment. It also enables the user to turn off the alarm before he considers the wake up signal to take an annoying form. Preferably, the control unit is further arranged to control the wake up signal such that said first part of the alert period and said subsequent part of the alert occur only once during the alert period.

In a special embodiment, the wake up sound producing device comprises a detection unit for detecting a position of a user relative to the wake up sound producing device and the control unit is arranged to direct the localized sound towards the user. The position of the user may, e.g., be detected using a camera and image recognition software, pressures sensors integrated in the user's bed, sound recording means for detecting sounds made by the sleeping user (e.g. breathing or snoring).

According to a second aspect of the invention, a method of providing an audible wake up signal during an alert period is provided, the method comprising initiating an alert period, during a first part of the alert period, generating and providing a diffuse sound as a first part of the wake up signal, and controlling the diffuse sound such that, at a predetermined target position, a diffuse spatial sound spectrum is provided having peak sound intensities from multiple directions, and during a subsequent part of the alert period, generating and providing a localized sound as a subsequent part of the wake up signal, and controlling the localized sound such that, at the predetermined target position, a localized spatial sound spectrum is provided having a maximum sound intensity from a single predetermined direction.

These and other aspects of the invention are apparent from and will be elucidated with reference to the embodiments described hereinafter.

DETAILED DESCRIPTION OF THE INVENTION

Figure 1:
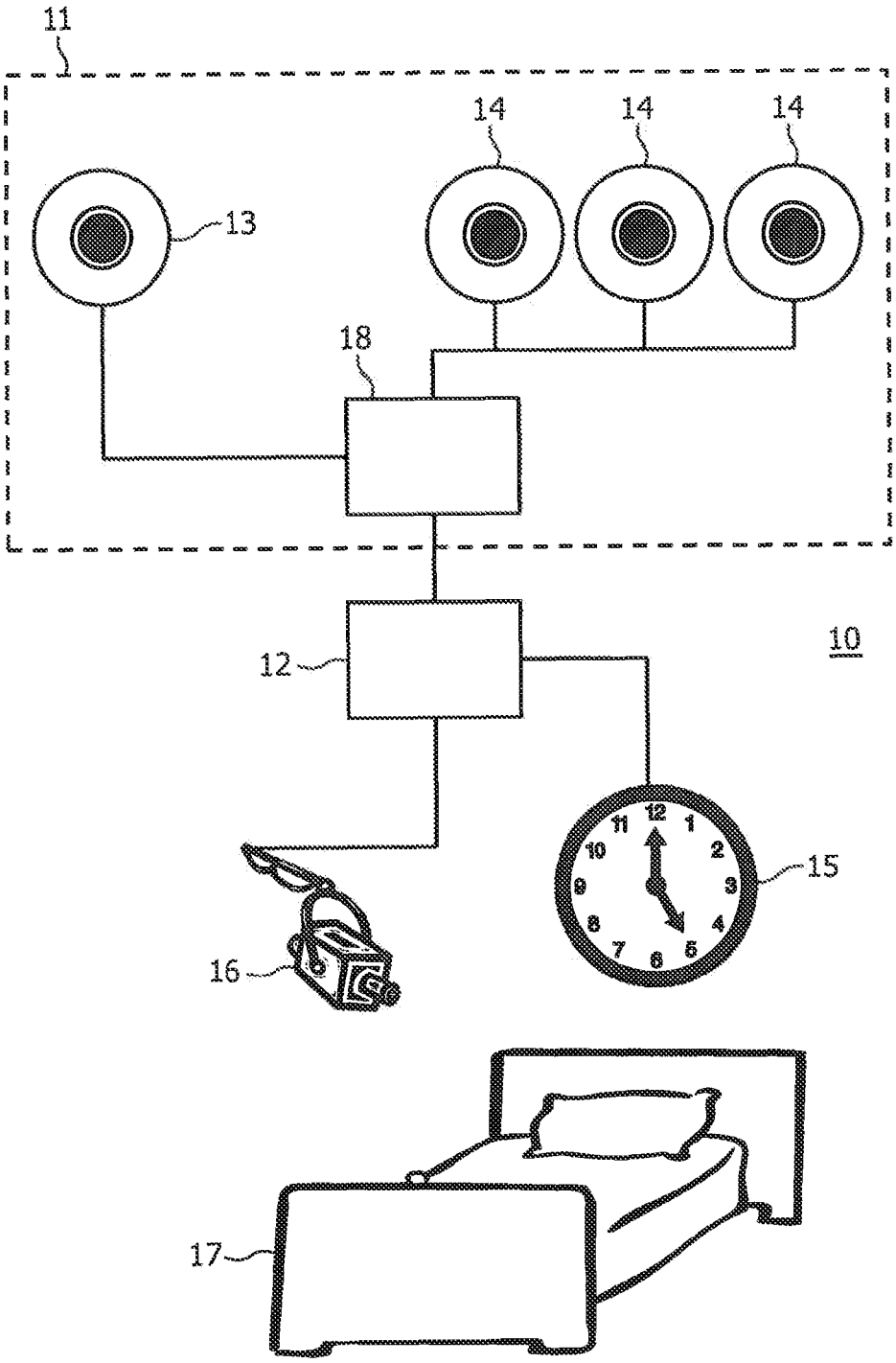
FIG. 1 schematically shows a wake up sound producing device according to the invention.

FIG. 1 schematically shows a wake up sound producing device 10 according to the invention. In the following, the wake up sound producing device 10 will be referred to as the wake up device 10. The wake up device 10 at least comprises a sound producing unit 11 and a control unit 12. The control unit 12 initiates an alert period when the user should wake up. The start of the alert period may e.g. be triggered by a clock 15, a light sensor or a user command (provided by someone else than the one who has to wake up). In the following, it will be assumed that the alert period is initiated by the clock 15 which is coupled to the control unit 12.

If the user wants to wake up at 6 AM, the alert period may start at 6 AM. However, with the wake up device 10 according to the invention the user will not wake up immediately at the start of the alert period when only a diffuse sound is provided. It is preferred to start the alert period some time earlier in order to be sure that the user is awake at 6 AM. The exact moment that the alert period should start may be fixed at, e.g., 15 minutes before the selected wake up time (6 AM) or may be user dependent. Information about the actual wake up time may be derived from, e.g. the moment at which the user turns off the alarm (e.g. pressing a button) or gets out of bed (e.g. detected by a pressure sensor or camera system). The information about the actual wake up time may be used to personalize the moment at which the alert period starts.

In this exemplary embodiment, the sound producing unit 11 comprises a sound processing unit 18, a front speaker 13 and a set of ambient speakers 14. The sound processing unit 18 controls the content and the loudness of the sound signals that are sent to the loudspeakers 13, 14. If the wake up device 10 is properly positioned, the front speaker 13 is facing the user, such that the sound coming from the front speaker 13 can directly travel towards the sleeping user, lying in his bed 17. The ambient speakers 14 are preferably provided at the side and/or back surfaces of the wake up device 10, such that the sound from those speakers 14 can only reach the user via reflections at nearby walls, ceilings or objects. In this example, three ambient speakers 14 are provided, but the wake up device 10 may comprise any number of ambient speakers 14. As will be elucidated below, the wake up device 10 may even function properly with the front speaker 13 only.

When the alert period starts, the sound producing unit 11 generates a diffuse sound as a first part of the wake up signal. Diffuse sound comes or appears to come from multiple direction, e.g. because the source is delocalized (e.g. street noise, a plurality of birds) or because the sound only reaches the user after various reflections. Diffuse sounds can be produced in different ways. E.g., the ambient speakers 14 may be provided at the back of the wake up device 11. When used, the wake up device 11 should be positioned such that its front surface faces the user. The sound form the ambient speakers 14 at the back of the device cannot reach the user directly, but only after reflections at, e.g., the wall or other objects in the room. Alternatively, digital reverberation may be used for generating or processing a sound that, although coming from a speaker 13 directly facing the user, sounds as a diffuse sound. Also the content selection for the wake up sound may add to the diffuseness of the sound. For example, bird sounds and street noise give a more diffuse perception than a ringing phone. Another way of creating diffuse sound will be discussed below with reference to FIG. 4.

During a subsequent part of the alert period, a more localized sound is provided as a subsequent part of the wake up signal. This more localized sound may come from a different speaker 13. Preferably, the localized sound comes from the front speaker 13 and reaches the user directly, without any reflections and without hitting upon any obstacles. Also the content of the localized sound may add to the localized character. For example, a ringing phone, a classis wake up alarm sound or a voice clearly directed at the user may be used as localized sound.

In a preferred embodiment, the sound processing unit 18 provides a gradual transition from a diffuse sound to a more localized sound. For example, the relative loudness of speakers 13, 14 with different orientations may be changed gradually. Also the orientation of the speakers 13, 14 or a position or orientation of acoustic obstacles or reflectors may be changed during the alert period. A gradual change of the content of the wake up signal may, e.g., be provided by mixing a diffuse sound with a localized sound and gradually changing the relative loudness of both sounds.

The device 10 shown in FIG. 1 also comprises a user detector, here in the form of a camera system 16. The camera 16 observes the user while lying in his bed 17. Image recognition software operated by the control unit 12 may be used for determining an exact location of the user's head. This information may be used for a very precise targeting of the localized sound. If two persons are sleeping in the same bed 17, the control unit 12 may be arranged to direct the localized sound at only one of them. In addition to a means for detecting a position of the user, the camera 16 may also be used to detect whether the user is asleep or awake. Detection of the moment at which the user wakes up may be useful for determining an optimal duration of the alert period for this user. Additionally, if the device 10 detects that the user is already awake, there may be no need to activate the alarm at all.

Instead of the camera 16, the device 10 may use different types of user detection means. For example, pressure sensors or heat sensors in the bed 17 and/or pillow may be used for determining a presence, location and/or orientation of the user. Alternatively, a microphone or microphone array or other sound detecting means may be provided for using breathing or snoring sounds to determine the location of the user.

Figure 2:
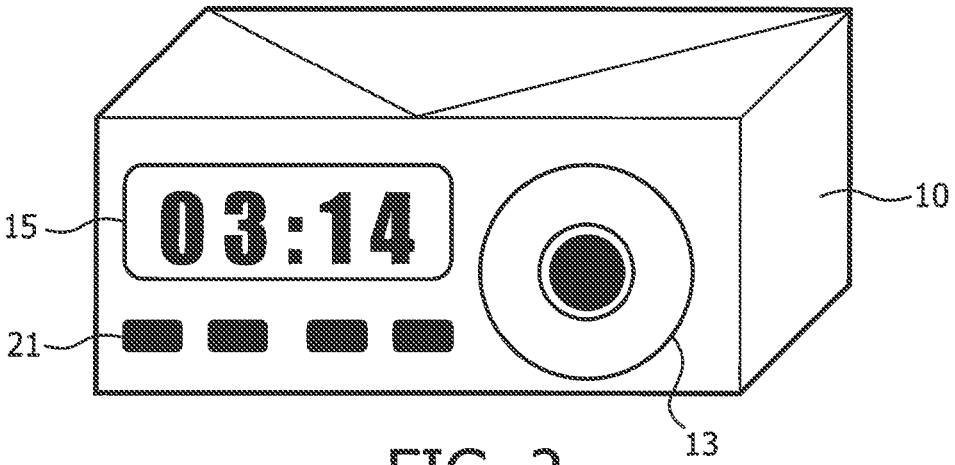
FIGS. 2 and 3 show a front view and a back view of an alarm clock according to the invention.
Figure 3:
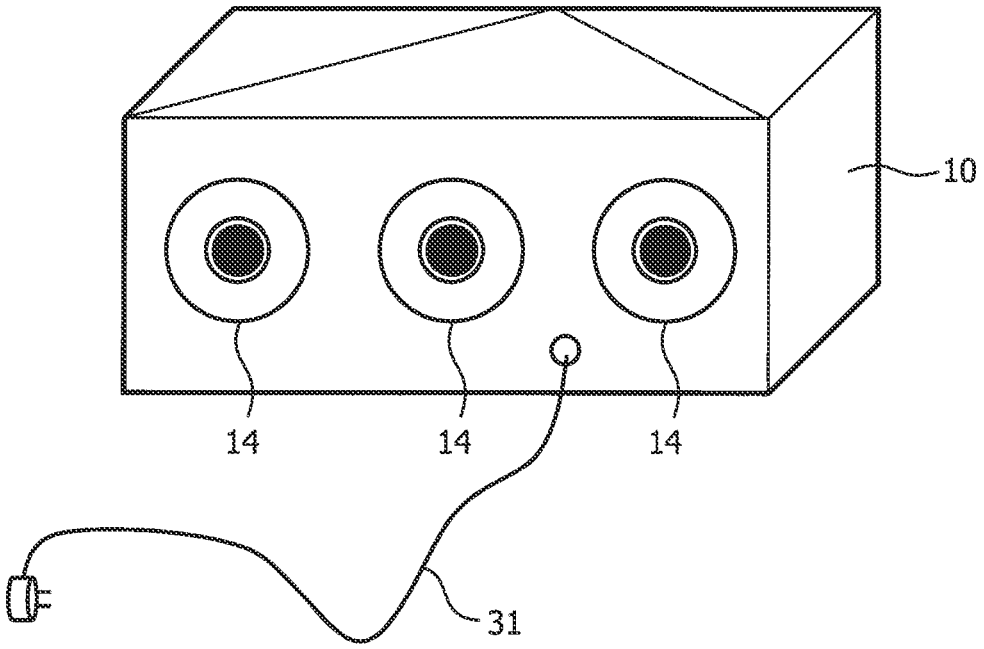

FIGS. 2 and 3 show a front view and a back view of an alarm clock 10 according to the invention. The device 10 comprises a clock 15 and some buttons 21 for controlling the device 10. The buttons may be used for, e.g., setting the current time or wake up time or for selecting a specific wake up program. The front speaker 13 is provided at the same side of the device 10 as the clock 15. If the device is positioned such that the user can look at the clock 15, the front speaker 13 will also be in a direct line of sight for the user. Because the front speaker 13 is in the direct line of sight, sounds coming from this speaker 13 will reach the user directly without any reflections and without hitting upon any obstacles. The front speaker 13 thus is very useful for providing the localized sounds.

In FIG. 3, the rear side of the device 10 is shown. Here a plurality of ambient speakers 14 is provided for providing diffuse sounds. During normal use, the front side of the device 10 faces the user. Because the ambient speakers 14 are at the back of the device 10, sound coming from the ambient speakers 14 can only reach the user after being reflected at a wall or object in the room. The sound from the ambient speakers reaches the user later than the sound from the front speaker 13. Even when all speakers 13, 14 produce the same sound at the same moment, the different sound paths between the speakers 13, 14 and the user result in a diffuse sound. The sound from different ones of the ambient speakers 14 may also travel different paths before reaching the user. If these different paths have different lengths, that will add to the diffuseness of the sound. It is to be noted that also the sound coming from a single ambient speaker 14 may reach the user via different paths. It is not necessary to use multiple ambient speakers 14.

Figure 4:
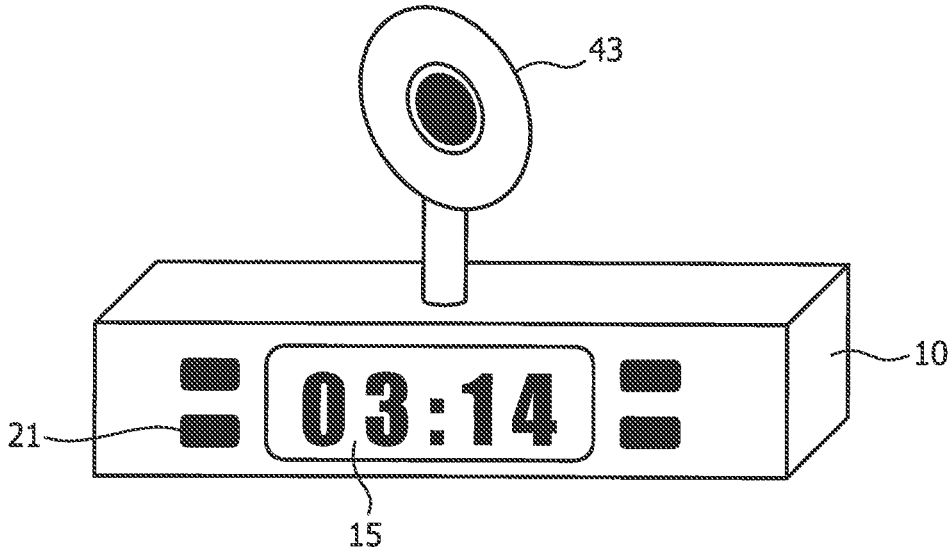
FIG. 4 shows a further embodiment of an alarm clock according to the invention, FIG. 5 schematically shows a loudspeaker array for use in a wake up sound producing device according to the invention.

FIG. 4 shows a further embodiment of an alarm clock 20 according to the invention. This alarm clock 20 comprises a rotatable speaker 43. When the speaker 43 is rotated such that it faces away from the user, the sound can only reach the user after one or more reflections and preferably via different paths. The sound will then be perceived as being diffuse and originating from multiple sources. When the speaker 43 is rotated such that it faces the user, the sound follows a straight path from the speaker 43 to the user and will be perceived as a localized sound directed at the user. During the alert period the speaker 43 may be rotated towards the user to obtain a gradual transition from diffuse to localized sound.

Figure 5:
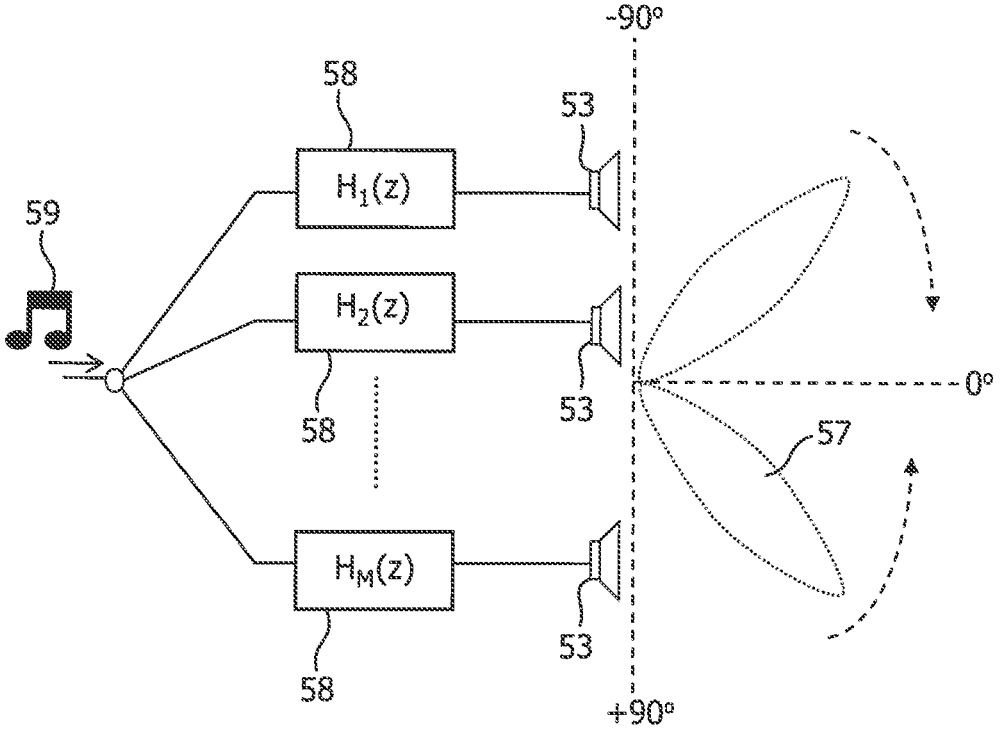

FIG. 5 schematically shows a loudspeaker array 53 for use in a wake up sound producing device according to the invention. A wake up sound 59 is provided to each speaker 53 in the loudspeaker array. Filters $H_1(z) \ldots H_M(z)$ 58 are associated with the respective speakers 53 Before a speaker 53 provides the wake up sound 59 as an audible signal, the wake up sound 59 is filtered by the respective filter 58. The separate audible signals from the speakers 53 in the array together form one audible signal 57 with a specified directivity. The $H_1(z) \ldots H_M(z)$ 58 specify the radiated energy as a function of the space directions. The array directivity may be controlled by specifying the directions where sound emission 57 is maximum or minimum. At the start of the alert period, the filters $H_1(z) \ldots H_M(z)$ 58 are configured such that a diffuse sound 57 is produced with a directivity of ±90°. During the alert period, the resulting sound output 57 may slowly converge toward the user direction. The user direction may be configured or assumed to be at a fixed angle (e.g. 0) with respect to the wake up device. In a preferred embodiment, the user position is detected, e.g. by a camera system or microphone array, and the directivity of the sound output 57 is adapted accordingly.

Figure 6:
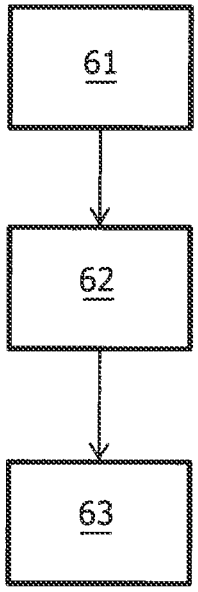
FIG. 6 shows a flow diagram of a method according to the invention.

FIG. 6 shows a flow diagram of a method according to the invention. The method comprises at least three steps 61, 62, 63. In activation step 61, the alert period is initiated. As described above the initiation of the alert period may be triggered by, e.g., a clock, a light detector or a user command. The alert period is preferably initiated at a user dependent amount of time before the moment at which the user would like to wake up. In diffuse alarm step 62, during a first part of the alert period, a diffuse sound is generated and provided to form a first part of the wake up signal. During a subsequent localized alarm step 63, a more localized sound is generated and provided. There may be an abrupt transition from the diffuse sound to the localized sound, but the transition is preferably realized gradually using any one or a combination of the technical implementations described above.

It will be appreciated that the invention also extends to computer programs, particularly computer programs on or in a carrier, adapted for putting the invention into practice. The program may be in the form of source code, object code, a code intermediate source and object code such as partially compiled form, or in any other form suitable for use in the implementation of the method according to the invention. It will also be appreciated that such a program may have many different architectural designs. For example, a program code implementing the functionality of the method or system according to the invention may be subdivided into one or more subroutines. Many different ways to distribute the functionality among these subroutines will be apparent to the skilled person. The subroutines may be stored together in one executable file to form a self-contained program. Such an executable file may comprise computer executable instructions, for example processor instructions and/or interpreter instructions (e.g. Java interpreter instructions). Alternatively, one or more or all of the subroutines may be stored in at least one external library file and linked with a main program either statically or dynamically, e.g. at run-time. The main program contains at least one call to at least one of the subroutines. Also, the subroutines may comprise function calls to each other. An embodiment relating to a computer program product comprises computer executable instructions corresponding to each of the processing steps of at least one of the methods set forth. These instructions may be subdivided into subroutines and/or be stored in one or more files that may be linked statically or dynamically. Another embodiment relating to a computer program product comprises computer executable instructions corresponding to each of the means of at least one of the systems and/or products set forth. These instructions may be subdivided into subroutines and/or be stored in one or more files that may be linked statically or dynamically.

The carrier of a computer program may be any entity or device capable of carrying the program. For example, the carrier may include a storage medium, such as a ROM, for example a CD ROM or a semiconductor ROM, or a magnetic recording medium, for example a floppy disc or hard disk. Further the carrier may be a transmissible carrier such as an electrical or optical signal, which may be conveyed via electrical or optical cable or by radio or other means. When the program is embodied in such a signal, the carrier may be constituted by such cable or other device or means. Alternatively, the carrier may be an integrated circuit in which the program is embedded, the integrated circuit being adapted for performing, or for use in the performance of, the relevant method.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A wake up alarm providing device comprising a sound producing unit for providing an audible wake up signal during an alert period and a control unit, coupled to the sound producing unit for controlling the wake up signal, the control unit being arranged to:

control the wake up signal to comprise a localized sound and a diffuse sound, the localized sound providing, at a predetermined target position, a localized spatial sound spectrum having a maximum sound intensity from a single predetermined direction, the diffuse sound providing, at the predetermined target position, a diffuse spatial sound spectrum having peak sound intensities from multiple directions, control the wake up signal such that a sum of the peak sound intensities of the diffuse sound exceeds the maximum sound intensity of the localized sound during a first part of the alert period, and control the wake up signal such that a ratio of the sum of the peak sound intensities of the diffuse sound to the maximum sound intensity of the localized sound is decreased during a subsequent part of the alert period.

2. A wake up alarm providing device as claimed in claim 1, wherein the control unit is further arranged to provide a gradual decrease of the ratio.

3. A wake up alarm providing device as claimed in claim 2, wherein the control unit is further arranged to control the wake up signal such that said first part of the alert period and said subsequent part of the alert occur only once during the alert period.

4. A wake up alarm providing device as claimed in claim 1, wherein the sound producing device comprises at least one loudspeaker, the control unit being arranged to produce the diffuse sound using digital reverberation.

5. A wake up alarm providing device as claimed in claim 1, wherein the sound producing device comprises at least two loudspeakers positioned under different angles.

6. A wake up alarm providing device as claimed in claim 1, wherein the sound producing device comprises at least two loudspeakers and wherein the control unit is further arranged to provide a gradual decrease of the ratio by controlling a relative loudness of the at least two loudspeakers.

7. A wake up alarm providing device as claimed in claim 1, further comprising a detection unit for detecting a position of a user relative to the wake up alarm providing device and wherein the control unit is arranged to direct the localized sound towards the user.

8. A wake up alarm providing device as claimed in claim 1, wherein the sound producing unit comprises at least one rotatable loudspeaker and wherein the control unit is further arranged to provide a gradual decrease of the ratio by rotating the at least one rotatable loudspeaker.

9. A wake up alarm providing device as claimed in claim 1, further comprising a clock coupled to the control unit, the control unit being arranged to initiate the alert period in dependence of the clock.

10. A method of providing an audible wake up signal during an alert period, the method comprising initiating an alert period, during a first part of the alert period, generating and providing a diffuse sound as a first part of the wake up signal, and controlling the diffuse sound such that, at a predetermined target position, a diffuse spatial sound spectrum is provided having peak sound intensities from multiple directions, and during a subsequent part of the alert period, generating and providing a localized sound as a subsequent part of the wake up signal, and controlling the localized sound such that, at the predetermined target position, a localized spatial sound spectrum is provided having a maximum sound intensity from a single predetermined direction.

11. A computer program product for providing an audible wake up signal; which program is operative to cause a processor to perform the method as claimed in claim 10.

* * * * *